US005265450A

United States Patent [19]

Doyle

[11] Patent Number: 5,265,450

[45] Date of Patent: Nov. 30, 1993

[54] LATCH HANDLE LOCK FOR TAILGATES

[76] Inventor: Pat Doyle, P.O. Box 9020, Austin, Tex. 78766

[21] Appl. No.: 847,642

[22] Filed: Mar. 5, 1992

[51] Int. Cl.[5] ..... E05B 65/12; E05B 65/06

[52] U.S. Cl. ..... 70/118; 296/57.1; 70/467; 70/258; 292/35; 292/DIG. 29

[58] Field of Search ..... 296/57.1 X; 292/DIG. 29, DIG. 36, 35, 36, 41, 48, 53; 70/151, 153, 467, 470, 472, 483–485, 489, 210, 150, 103, 224, 258, 201

[56] References Cited

U.S. PATENT DOCUMENTS

| | | | |
|---|---|---|---|
| 4,813,722 | 3/1989 | Viscome et al. | 70/224 |
| 4,892,338 | 1/1990 | Weinerman et al. | 292/35 |
| 4,951,486 | 8/1990 | Braun et al. | 70/208 |
| 5,004,287 | 4/1991 | Doyle | 292/DIG. 43 |

FOREIGN PATENT DOCUMENTS

| | | | |
|---|---|---|---|
| 48615 | 4/1934 | Denmark | 292/36 |
| 9008872 | 8/1990 | World Int. Prop. O. | 292/36 |

*Primary Examiner*—Peter M. Cuomo
*Assistant Examiner*—Darnell M. Boucher
*Attorney, Agent, or Firm*—Keeling & Assoc.

[57] ABSTRACT

A locking device is provided for a pickup truck tailgate having a conventional latching mechanism of the type comprising spring-loaded plungers engaging plunger receivers in the truck body, draw bars connecting the plungers to a scissor-plate latching mechanism the upper ends of the scissor plates being rotated toward each other to release the plungers. The locking device comprises a blocking paddle for removable insertion between the scissor plates of the latching mechanism, the blocking paddle being rotatably mounted on a spindle with attached spring means normally orienting the blocking paddle away from the scissor plates, the blocking paddle and spindle being attached by mounting members to the tailgate body. The locking device further comprises a lock attached to the tailgate body having a lock cylinder, the lock cylinder being beveled at the end opposite the lock key insert. A semi-circular aperture is provided in the blocking paddle the radius of the circular portion of the apertures being slightly greater than the radius of the lock cylinder. The lock and lock cylinder are so positioned in relation to the blocking paddle and blocking paddle aperture that the bevelled edge of the lock cylinder extends through the semi-circular aperture of the blocking paddle when the lock cylinder is in a first unlocked position. Upon rotation of the lock cylinder to a second locked position the bevelled edge of the lock cylinder engages the flat side of the semi-circular opening of the blocking plate causing the blocking plate to rotate to a second position between the scissor plates of the latching mechanism thereby preventing the scissor plates from rotating toward each other and consequently preventing release of the plungers from the plunger receivers.

9 Claims, 2 Drawing Sheets

LATCH HANDLE LOCK FOR TAILGATES

BACKGROUND OF THE INVENTION

This invention pertains generally to locking devices and in particular to a latch handle locking device for a conventional pickup truck tailgate.

Conventional pickup truck tailgates are attached to the body of the truck, allowing the tailgate to be latched in a vertical position and to be opened to a full horizontal position about the axis of hinges provided at the bottom of the tailgate. Conventional pickup trucks provide for relative convenience of removal of the tailgate to allow flexibility of use of the pickup truck.

A disadvantage of the relatively simple removal of tailgates is that they are frequently stolen. Conventional locking devices may be provided at the upper end of the tailgate, which devices are typically attached to the tailgate rather than made an integral part of the tailgate, thereby allowing access to the exposed locking mechanism and attached hardware.

The locking device of the present invention provides an improvement over existing locking systems for pickup truck tailgates in that it provides an integrally mounted locking device which utilizes and works with the existing tailgate latching mechanism. The locking device of the present invention requires minimal time and effort to install, can be installed on most existing pickup trucks as well as new pickup trucks, allows minimal exposure to criminal elements, and does not degrade the appearance of the vehicle.

Doyle U.S. Pat. No. 5,004,287 teaches the use of a lock bolt located in the axis of the hinge pin member and receiver cup of a pickup truck to prevent removal of a removable tailgate.

Various U.S. Patents reflect locking devices and/or hinge assemblies, including Gergoe U.S. Pat. No. 4,076,301, Cain U.S. Pat. No. 3,924,293, McHeffey U.S. Pat. No. 3,911,621, Nagy, et al., U.S. Pat. No. 3,733,649, Foltz U.S. Pat. No. 3,475,684, Lauer, et al., U.S. Pat. No. 2,640,723, Haught U.S. Pat. No. 2,183,291, and Jett, et al., U.S. Pat. No. 2,022,886.

It is a purpose of the present invention to provide a locking device for a pickup truck tailgate having a conventional scissor-plate latching mechanism.

It is a further purpose of the present invention to provide a locking device which may be readily installed on existing conventional tailgates for pickup trucks.

It is further purpose of the present invention to provide a locking device which may be installed on existing conventional tailgates for pickup trucks which utilizes the existing latching mechanism to secure the tailgate to the pickup truck.

SUMMARY OF THE INVENTION

The foregoing and other objects of the present invention are accomplished by a locking device for a pickup truck tailgate having a conventional latching mechanism of the type comprising spring-loaded plungers engaging plunger receivers in the truck body, draw bars connecting the plungers to a scissor-plate latching mechanism, the scissor plates being rotated toward each other to release the plungers. The locking device comprises a blocking paddle for removable insertion between the scissor plates of the latching mechanism, the blocking paddle being rotatably mounted on a spindle with attached spring means normally orienting the blocking paddle away from the scissor plates, the blocking paddle and spindle being attached by mounting members to the tailgate body. The locking device further comprises a lock attached to the tailgate body having a lock cylinder, the lock cylinder being beveled at the end opposite the lock key insert. A semi-circular aperture is provided in the blocking paddle the radius of the circular portion of the apertures being slightly greater than the radius of the lock cylinder. The lock and lock cylinder are so positioned in relation to the blocking paddle and blocking paddle aperture that the bevelled end of the lock cylinder extends through the semi-circular aperture of the blocking paddle when the lock cylinder is in a first unlocked position. Upon rotation of the lock cylinder to a second locked position the bevelled edge of the lock cylinder engages the flat side of the semi-circular opening of the blocking plate causing the blocking plate to rotate to a second position between the scissor plates of the latching mechanism thereby preventing the scissor plates from rotating toward each other and consequently preventing release of the plungers from the plunger receivers.

DESCRIPTION OF THE PREFERRED EMBODIMENT

Figure 1:
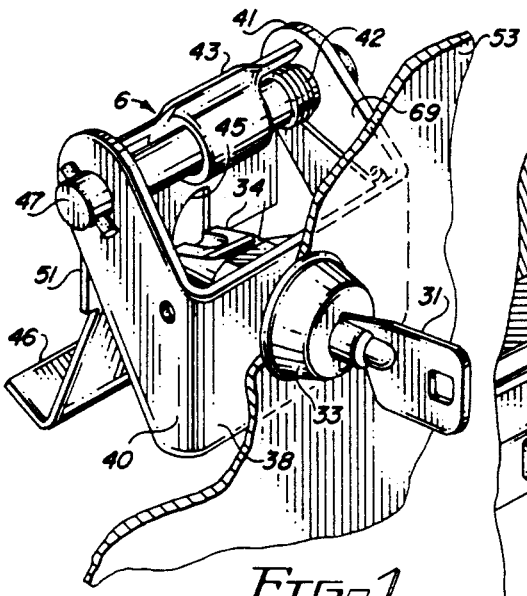
FIG. 1 illustrates a perspective view of the locking device of the present invention.

Referring first to FIG. 1, the locking device 6 of the present invention is depicted in perspective together with a cutaway portion of rear tailgate wall 53, rear tailgate wall 53 being the wall of the tailgate opposite the front of the pickup truck. A blocking paddle 43 comprising blocking paddle body 51 and blocking paddle extension 46 is rotatably mounted on spindle 47. Spindle 47 is supported by locking device frame 38, which locking device frame 38 is fixedly attached the interior of rear tailgate wall 53. Lock case 33 and lock cylinder 32, lock cylinder 32 having a bevelled edge 34, are fixedly attached to the interior of rear tailgate 53 and to locking device frame 38.

Figure 5:
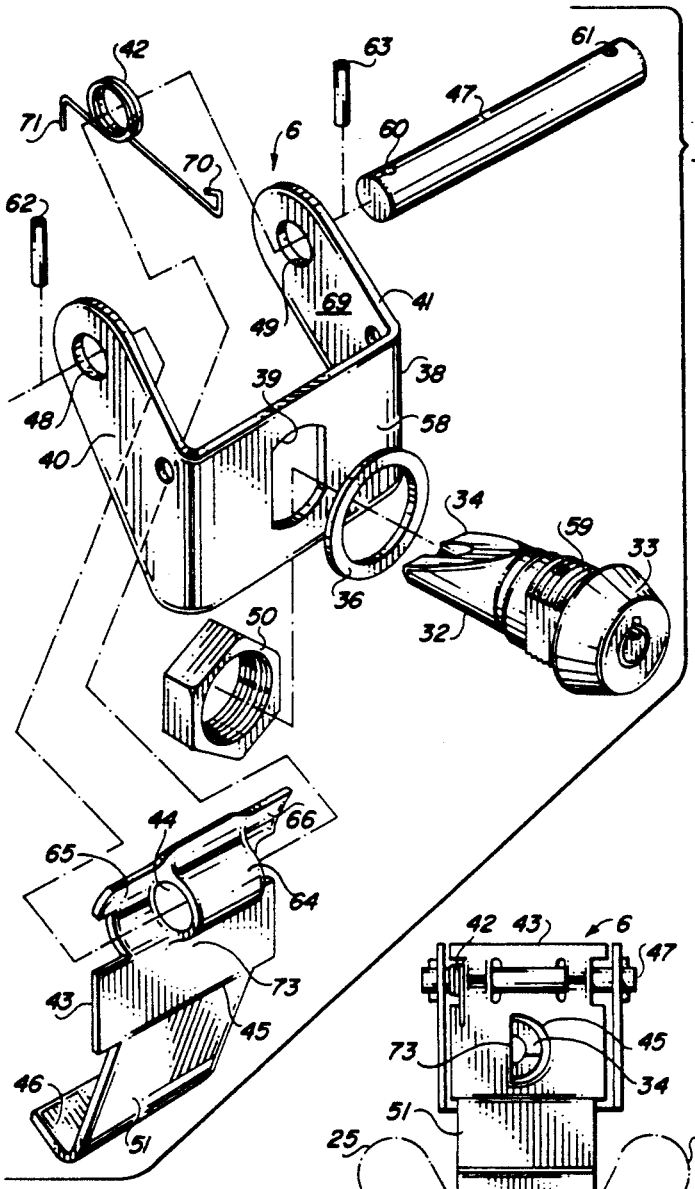
FIG. 5 illustrates the unassembled components of the locking device of the present invention prior to assembly.
Figure 6A:
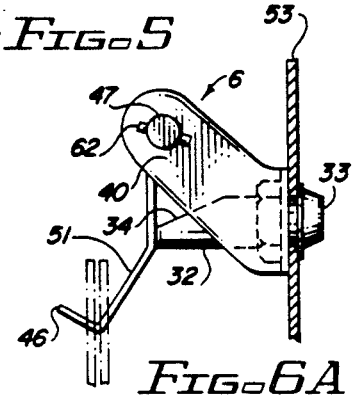
FIG. 6A illustrates a profile view of the pickup truck tailgate locking device of the present invention installed on a tailgate with the lock engaged.
Figure 6B:
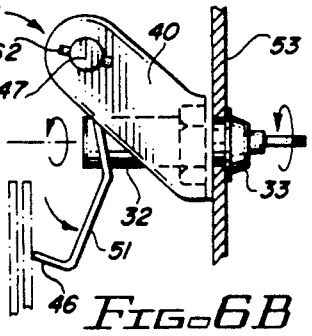
FIG. 6B illustrates a profile view of the locking device of the present invention installed on a tailgate with the lock disengaged.
Figure 7A:
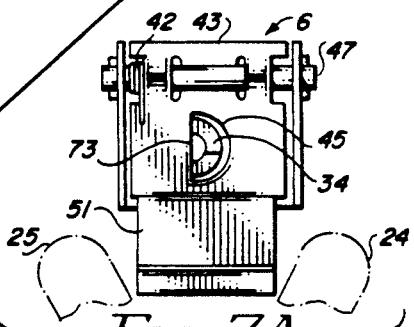
FIG. 7A illustrates a rear view of the locking device of the present with the lock engaged.
Figure 7B:
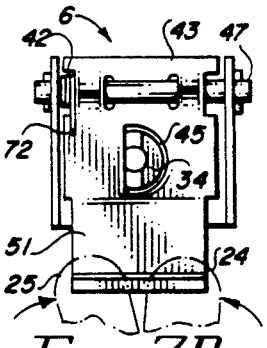
FIG. 7B illustrates a rear view of the locking device of the present invention with the lock disengaged.
Figure 8A:
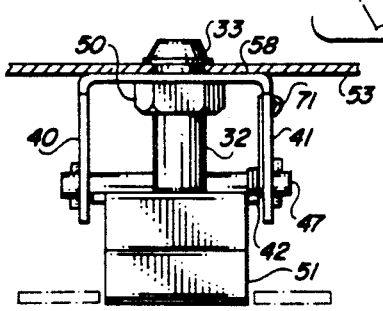
FIG. 8A illustrates a bottom view of the locking device of the present invention with the lock engaged.
Figure 8B:
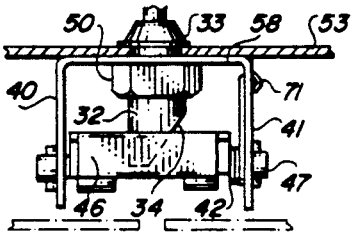
FIG. 8B illustrates a bottom view of the locking device of the present invention with the lock disengaged.

Referring to FIG. 5, the unassembled components of the locking device 6 of the present invention are depicted. Locking device frame 38 comprises a generally rectangular central member 58. Support member 40 extends generally perpendicularly in the vertical plane from one end of central member 58. Support member 41 extends generally perpendicularly in the vertical plane from the end of central member 58 opposite support member 40. Support member 40 and support member 41 each extend in the same general direction and each extend upward from central member 58 at an angle of approximately forty-five degrees. In the preferred embodiment locking device frame 38 may be from a single piece of sheetmetal bent ninety degrees at each end of central member 58 to cause support members 40 and 41 to extend perpendicularly.

An aperture 39 is provided near the center of central member 58 which aperture 39 is so sized as to be slightly larger than the axial dimensions of the generally oval threaded cylinder 59. Vertical sides are provided on aperture 39 to correspond with vertical sides of the generally oval threaded cylinder 59.

A round aperture 48 is provided at the end of support member 40 opposite the end attached to body member 58. A corresponding round aperture 49 is provided in the end of support member 41 opposite central member 58. Apertures 48 and 49 are so sized and located in relation to each other and to spindle 47 as to allow spindle 47 to be inserted through apertures 48 and 49 with the resulting position of spindle 47 being parallel to central member 58 and higher than aperture 39. Spindle 47 is slightly longer than the distance between aperture 48 and aperture 49 allowing spindle 47 to extend slightly outward from support member 40 and support member 41.

Aperture 60 and aperture 61 are each provided at opposing ends of spindle 47, apertures 60 and 61 being so located as to be just outside respective support members 40 and 41. Pin 62 is so sized as to tightly engage aperture 60. Pin 63 is so sized as to tightly engage aperture 61. Each of pins 62 and 63 are slightly longer than the diameter of spindle 47. Upon assembly, pins 62 and 63 prevent lateral movement of spindle 47 in relation to support member 40 while allowing spindle 47 to rotate axially.

Still referring to FIG. 5, blocking paddle 43 comprises a blocking paddle body 51 and a blocking paddle extension 46. Blocking paddle body 51 comprises a generally flat member provided with two (2) parallel punched slots at is upper end, with the area of the member between the slots stamped to define protrusion 64 outwardly from the plane defined by the flat surface and the areas outside the slots being stamped to define protrusion 65 and protrusion 66 extending in the direction opposite protrusion 64 thereby defining generally circular aperture 44 at one such slot and a corresponding aperture (not shown) at the other slot.

Aperture 44 and the corresponding aperture (not shown) are sized so as to have diameters larger than the diameter of spindle 47 thereby allowing blocking paddle 43 to rotate freely about the axis of spindle 47.

Blocking paddle extension 46 extends downwardly from blocking body 51. Blocking paddle extension 46 extends initially away from the plane of central member 58 of locking device frame 38 at an acute angle. Blocking paddle extension 46 is further bent at an angle of approximately ninety degrees near its unattached end, with the result that the unattached end of blocking paddle extension 46 extends away from central member 58 and upward from a horizontal plane.

A semi-circular aperture 45 is provided in blocking paddle body 51. Aperture 45 is so located with reference to aperture 39 of central member 58 that insertion of threaded cylinder 59 extending into aperture 39 results in engaging contact of lock cylinder 32 with aperture 45.

Lock case 33, threaded cylinder 59 and lock cylinder 32 together comprise a conventional cylinder lock. Bevelled edge 34 is provided at the end of lock cylinder 32 opposite lock case 33.

Support members 40 and 41, blocking paddle 43 and lock cylinder 32 are so sized and located in relation to each other that upon assembly with lock cylinder 32 in a first position lock cylinder 32 extends through aperture 45 of blocking paddle 43 with bevelled edge 34 in engaging contact with the flat surface 73 of semi-circular aperture 45.

Aperture 69 is provided in support member 41. Spring 42 is coiled around spindle 47 with spring end 70 extending through aperture 69 and engaging support member 41. Opposing spring end 71 engages protrusion 72 of blocking paddle 43 to normally orient blocking paddle 43 toward lock cylinder 32.

Figure 2:
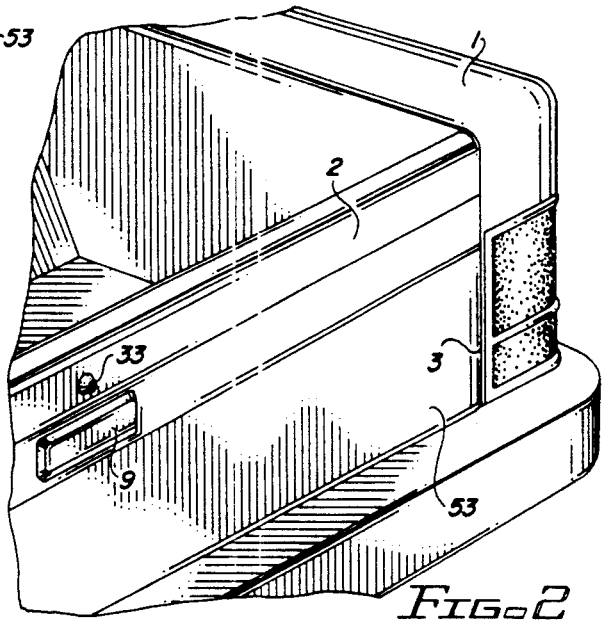
FIG. 2 illustrates a partial view of a pickup truck tailgate with the locking device installed.

Referring to FIG. 2, a conventional tailgate 2 is depicted, having latch handle 9. The tailgate 2 may be opened by downward rotation about a hinge (not shown) located at the lower right corner 3 and a corresponding hinge (not shown) at the lower left corner (not shown) of tailgate 2.

Figure 3A:
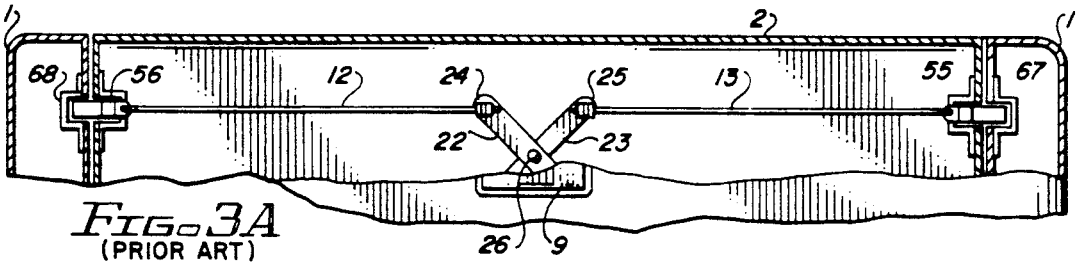
FIG. 3A (PRIOR ART)
FIG. 3A illustrates a cut-away view of a conventional pickup truck tailgate and latching mechanism with connecting hardware in the latched position.
Figure 3B:
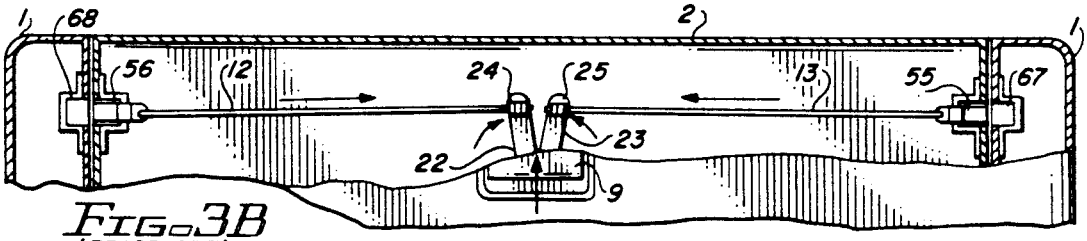
FIG. 3B (PRIOR ART)
FIG. 3B illustrates a cut-away view of a conventional pickup truck tailgate and latching mechanism with connecting hardware in the unlatched position.
Figure 4A:
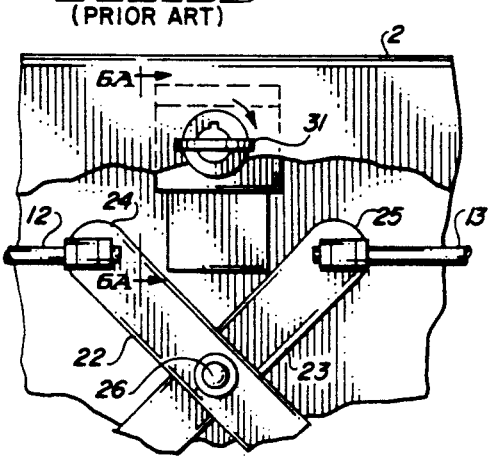
FIG. 4A illustrates a cut-away view of a conventional pickup truck tailgate latching mechanism with the locking device of the present invention installed and in the locked position.
Figure 4B:
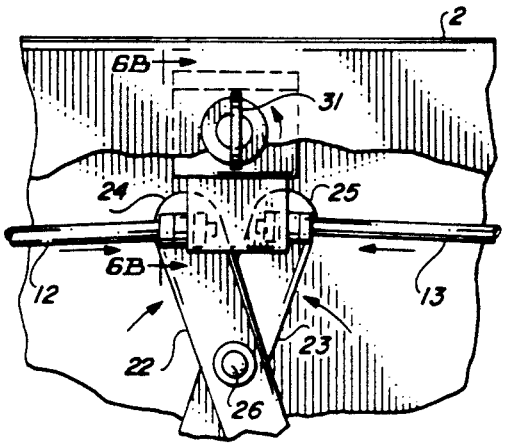
FIG. 4B illustrates a cut-away view of truck tailgate latching mechanism with the locking device of the present invention installed with the lock disengaged.

Referring to FIGS. 3A and 3B, tailgate 2 is latched to pickup truck 1 by means of spring-loaded plunger 55 and spring-loaded plunger 56. Plunger 55 and plunger 56 each protrude from opposing upper ends of tailgate 2. In the latched position plungers 55 and 56 extend into plunger receiver 67 and plunger receiver 68 respectively provided in pickup truck body 1.

Plunger 56 is connected to latch scissor plate 22 at its upper end 24 by draw bar 12. Plunger 55 is connected to latch scissor plate 23 at its upper end 25 by draw bar 13. Scissor plate 22 and scissor plate 23 each rotate about centrally-located rivet 26. By pulling latch handle 9 upper end 24 of scissor plate 22 and upper end 25 of scissor plates 22 and 23 are rotated about the axis of rivet 26 toward each other. (The details of connection of latch handle 9 with scissor plates 22 and 23 ar not depicted.) Rotation of ends 24 and 25 toward each other results in horizontal movement of draw bars 12 and 13 and corresponding withdrawal of plungers 55 and 56 from plunger receivers 67 and 68 and withdrawal of plunger receiver 55 from plunger receiver 67, thereby releasing tailgate 2 at its upper end for opening movement.

Referring to FIG. 2 the location of installation of locking device 6 is depicted with lock case 33 projecting outwardly from rear tailgate wall 53.

Referring to FIG. 1 together with FIG. 5, the attachment of the locking device 6 to rear tailgate inner wall 53 is depicted. Lock cylinder 32 and threaded cylinder 59 are inserted through an aperture (not shown) provided in rear tailgate wall 53 and through aperture 39 with the body of rear tailgate wall 53 located between lock case 33 and frame central member 58. A washer is provided between lock case 33 and rear tailgate wall 53. Lock case 33, rear tailgate wall 53, and frame central member 58 are tightly engaged by nut 50. Upon installation block paddle extension 46 extends into the area above rivet 26 connecting scissor plates 22 and 23.

OPERATION

FIGS. 4B, 6B, 7B AND 8B, depict the locking device 6 of the present invention in a first position with the lock disengaged. In the disengaged position the bevelled edge 34 of lock cylinder 32 is aligned with the flat side 73 of semi-circular aperture 45 allowing lock cylinder 3 to extend through aperture 45 until bevelled edge 34 engages the flat side 73 of semi-circular opening 45. Spring 42 biases blocking paddle 43 against lock cylinder 32. In the first position the blocking paddle extension 46 is located between rear tailgate wall 53 and scissor plates 22 and 23, allowing free movement of the upper ends 24 and 25 of scissor plates 22 and 23 toward each other about the axis of rivet 26, thereby allowing the withdrawal of plungers 55 and 56 from plunger receivers 67 and 68 and the unlatching of tailgate 2.

Upon rotation of key 31 toward the locked position the lock cylinder 32 is rotated. Rotation of lock cylinder 32 causes bevelled edge 34 to exert pressure against the flat surface 73 of aperture 39 thereby pushing blocking paddle 43 away from rear tailgate wall 53 and toward scissor plates 22 and 23. Upon rotation of lock cylinder 32 ninety degrees from its first position to the second then locked position the rotating bevelled edge 34 has pushed the blocking paddle 43 to a second position whereby blocking paddle extension 46 is located between upper ends 24 and 25 of scissor plates 22 and 23 thereby preventing rotation of the upper ends 24 and 25 of scissor plates toward each other and further preventing disengagement of plungers 55 and 56 from plunger receivers 67 and 68.

FIGS. 4A, 6A, 7A and 8A depict the locking device 6 in the second position with the locking device engaged. Upon disengagement of the locking device (unlocking) the lock cylinder 32 is again rotated until bevelled edge 34 is parallel to flat side 73 of aperture 39 thereby allowing spring 42 to bias blocking paddle 43 toward rear tailgate wall 53 and away from the scissor plates 22 and 23 to the first position previously described.

Although this invention has been described fully with special emphasis upon a preferred embodiment, it should be understood that within the scope of the appended claims the invention may be practiced otherwise than as specifically described herein.

I claim:

1. In combination with a pickup truck tailgate having a conventional latching mechanism comprising spring-loaded plungers engaging plunger receivers in the truck body, draw bars connecting the plungers to a scissor-plate latching mechanism, and scissor plates having ends rotated toward each other to release the plungers, a locking mechanism comprising:

blocking means to prevent said scissor plate ends from rotating toward each other;

structure means for supporting said blocking means in a first position and in a second position;

positioning means for retractable movement of said blocking means between said first position and said second position;

said first position including the location of said blocking means between said scissor plate ends;

said second position including the location of said blocking means at a position removed from said scissor plate ends;

said blocking means including a blocking paddle rotatably connected to said structure means at a first end;

said structure means comprising a generally rectangular central member, an aperture in said central member, side members attached to opposite sides of said central member, said side members extending angularly from said central member;

a spindle supported between said side members, said side members each having aligned apertures through which said spindle extends;

said spindle further extending through a blocking paddle extension constructed to rotatably receive said spindle;

said positioning means comprising a coil wire spring;

a first end of said coil wire spring attached to said structure means;

a second end of said coil wire spring connected to said blocking paddle to bias said blocking paddle in said second position;

said blocking paddle provided with a semi-circular aperture;

said positioning means comprising a locking device including a lock case, a threaded body, and a lock cylinder, said lock cylinder having at least one bevelled edge;

said threaded body of the locking device extending through an aperture in the pickup tailgate, said threaded body extending through the aperture in the generally rectangular central member;

said locking device secured to the tailgate and said central member by a nut threaded onto the threaded body;

said lock cylinder in a first unlocked position aligned with said semi-circular aperture and protruding through said semi-circular aperture thereby allowing said blocking paddle to be biased in said second position; and said lock cylinder in a second locked position not aligned with the semi-circular aperture thereby engaging the blocking paddle and moving the blocking paddle to said first position.

2. In combination with a pickup truck tailgate having a conventional latching mechanism comprising spring-loaded plungers engaging plunger receivers in the truck body, draw bars connecting the plungers to a scissor-plate latching mechanism, the scissor-plate latching mechanism having scissor-plate ends rotated toward each other to release the plungers from the plunger receivers, a locking mechanism comprising:

blocking means to prevent said scissor-plate ends from rotating toward each other;

structure means for supporting said blocking means in a first and second position;

said first position including the location of said blocking means between said scissor-plate ends;

said second position including the location of said blocking means at a position removed from said scissor-plate ends;

said blocking means rotatably attached to said structure means;

said blocking means including at least one planar surface;

said planar surface having an asymmetrical opening provided therein;

biasing means to bias the blocking means in the second position;

positioning means including a rod member having a cross-sectional configuration to closely fit within the asymmetrical opening of the planar surface which positioning means in a first axial orientation is not coincident with the asymmetrical opening and which positioning means in a second axial orientation is coincident with the asymmetrical opening and extends through the asymmetrical opening;

whereby the blocking means is biased in the second position by the biasing means and is moveable to said first position by withdrawing the positioning means from the asymmetrical opening, positioning the rod member in the first axial orientation and pressing the rod member against the planar surface with a force sufficient to exceed the force of the biasing means;

the positioning means including a lock fixedly attached to the truck body, and said rod member is a rotatable rod member capable of orientation in the first axial orientation and in the second axial orientation, said rod member being further laterally moveable in relation to said blocking means.

3. An apparatus according to claim 2 wherein said biasing means comprises a coil spring operatively engaged with said blocking means and said support means.

4. An apparatus according to claim 2 wherein said structure means comprises a central member, side members extending from said central member, said side members extending generally in the same direction;

a spindle supported between the structure means side members; and said blocking means rotatably attached to said spindle.

5. An apparatus according to claim 2 wherein said blocking means comprises a paddle having a planar surface rotatably connected at a first end to the structure means.

6. An apparatus according to claim 5 wherein said paddle includes an angularly extending member at the distal end of said paddle.

7. An apparatus according to claim 4 wherein said blocking means comprises a paddle having a planar surface rotatably connected at a first end to the spindle, said paddle having an angularly extending member at a second end distal from the first end.

8. The apparatus according to claim 2 wherein said planar surface asymmetrical planar surface opening is semi-circular and the rod member cross-sectional configuration is semi-circular.

9. The apparatus according to claim 2 wherein said lock is a cam lock, said lock having an asymmetrical lock cylinder, said asymmetrical lock cylinder having a cross-sectional configuration coincident with and insertable in said planar surface asymmetrical opening.

* * * * *